United States Patent [19]

Sakurada et al.

[11] 4,148,522

[45] Apr. 10, 1979

[54] SEAT BACKREST WITH ADJUSTABLE LUMBAR SUPPORTER

[75] Inventors: Kenichi Sakurada, Yokohama; Takaichi Nishino, Hachioji, both of Japan

[73] Assignees: Nissan Motor Company, Limited, Yokohama; Tachikawa Spring Company, Limited, Akishima, both of Japan

[21] Appl. No.: 904,231

[22] Filed: May 9, 1978

[30] Foreign Application Priority Data

May 25, 1977 [JP] Japan ..... 52-61325

[51] Int. Cl.[2] ..... A47C 3/00; A47C 7/46

[52] U.S. Cl. ..... 297/284

[58] Field of Search ..... 297/284

[56] References Cited

U.S. PATENT DOCUMENTS

| | | | |
|---|---|---|---|
| 3,762,769 | 10/1973 | Poschl | 297/284 |
| 3,948,558 | 4/1976 | Obermeier et al. | 297/284 |
| 3,973,797 | 8/1976 | Obermeier et al. | 297/284 |

*Primary Examiner*—Francis K. Zugel

[57] ABSTRACT

Herein disclosed is a seat backrest with an adjustable lumbar supporter which comprises a rod transversely crossing frame members of the seatback to be rotatable about the axis thereof relative to the frame members, an arm member secured to the rod, a support member pivotally connected to the arm member, lumbar pressing means such as spring connected to the support member, first control means for permitting the support member to rotate about its pivoted portion relative to the arm member when operated, and second control means for permitting the arm member and thus the rod to rotate about the axis of the rod relative to the frame members when operated.

12 Claims, 8 Drawing Figures

SEAT BACKREST WITH ADJUSTABLE LUMBAR SUPPORTER

FIELD OF THE INVENTION

The present invention relates in general to a vehicle seat and more particularly to a seat backrest whose contour is adjustable to conform to the lumbar contour of a particular occupant in a vehicle.

BACKGROUND OF THE INVENTION

Throughout the specification, the terms "forward" and "rearward" are to be understood as referring to "in the direction to the front of the subject seat" and "in the direction to the rear of the subject seat", respectively and "upward" and "downward" to be taken as upward and downward with respect to the subject seat, respectively.

For increased riding comfort and for minimum occupant fatigue, a vehicle seat backrest must support the lumbar area of the seat occupant's back. But, it is recognized that the construction of universally satisfactory permanent seat structures can not be effected because of difference in individual body sizes and proportions.

In view of the above, it has become popular to equip a vehicle seat with a so-called "adjustable lumbar supporter" held in the backrest of the seat. However, such an adjustable lumbar supporter conventionally used still has a limitation in setting a plurality of positions. In fact, the adjustment of the supporter is limited to either forward-rearward positioning or upward-downward positioning. More specifically, the positioning of the lumbar supporter is made by moving it monodirectionally. Thus, the most desired and effective positioning of the supporter for properly supporting the lumbar area of the seated occupant has not been obtained.

SUMMARY OF THE INVENTION

Therefore, an object of the present invention is to provide a seat which is equipped at the backrest thereof with an improved adjustable lumbar supporter which is adjustable in both forward-rearward directions and upward-downward directions for the proper supporting of the seated occupant's lumbar area irrespective of differences in individual body sizes and proportions.

According to the present invention, there is provided a seat backrest having two parallel but spaced frame members by which a contourable portion constituted by padding means is supported, and a lumbar supporter for imparting a curvature to the contourable portion to produce a desired contour, the lumbar supporter comprising: a rod transversely passing the frame members and rotatable about the axis thereof relative to the frame members, an arm member secured at its one end to the rod and located between the frame members, a support member pivotally connected to the arm member, lumbar pressing means connected to the support member, first control means for permitting the support member to rotate about its pivoted portion relative to the arm member when operated, and second control means for permitting the arm member and thus the rod to rotate about the axis of the rod relative to the frame members when operated.

SUMMARY OF THE DRAWINGS

Other objects and advantages of the present invention will become apparent from the following description when taken in conjunction with the accompanying drawings, in which.

DESCRIPTION OF THE PREFERRED EMBODIMENTS

Figure 1:
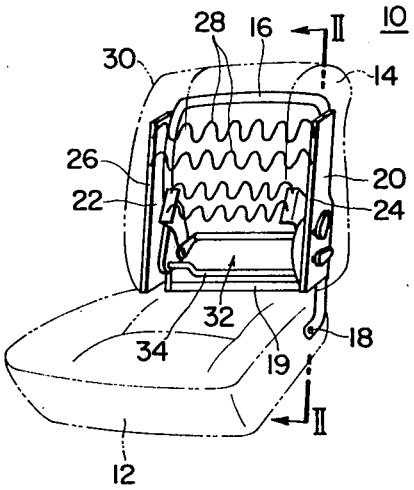
FIG. 1 is a perspective but partially broken view of a seat according to the present invention.

In the drawings, the points denoted by "GW" and "SW" are to be understood as "gas welding point" and "spot welding point", respectively.

Referring to FIG. 1 of the drawings, there is illustrated a seat of the present invention, as being generally designated by numeral 10. The seat 10 generally comprises a seat proper 12 mounted through suitable supporting means on the floor (not shown) of a vehicle, and a backrest 14 pivotally connected to a rear portion of the seat proper 12 in a manner as will be apparent from the following. The backrest 14 comprises an archshaped tubular frame 16 having foot portions pivotally connected via pivot pins 18 to rear portions of side frames (not shown) of the seat proper 12. A tubular lower frame 19 is secured via welding to lower sections of leg portions of the frame 16 to span the same. Side brackets 20 and 22 are secured via welding to the leg portions of the tubular frame 16 to permit each longitudinal edge to evenly project forwardly as shown. The respective edges of the side brackets 20 and 22 are formed with flanges 25 and 26 extending toward each other. Bridged between the side brackets 20 and 22, more particularly the flanges 24 and 26 are alternately curved spring wires 28 which are parallel with each other. These elements, such as the tubular frame 16 and side brackets 20 and 22, are wrapped by conventional padding means which is indicated by a phantom line 30. Denoted by numeral 31 (shown in FIG. 3) is a substantially rectangularly formed spring wire which is fixedly connected via welding to the tubular frame 16 and the tubular lower frame 19. Within the backrest 14, an adjustable lumbar supporter constituting an important part of the invention is disposed, which is generally designated by numeral 32.

Figure 2:
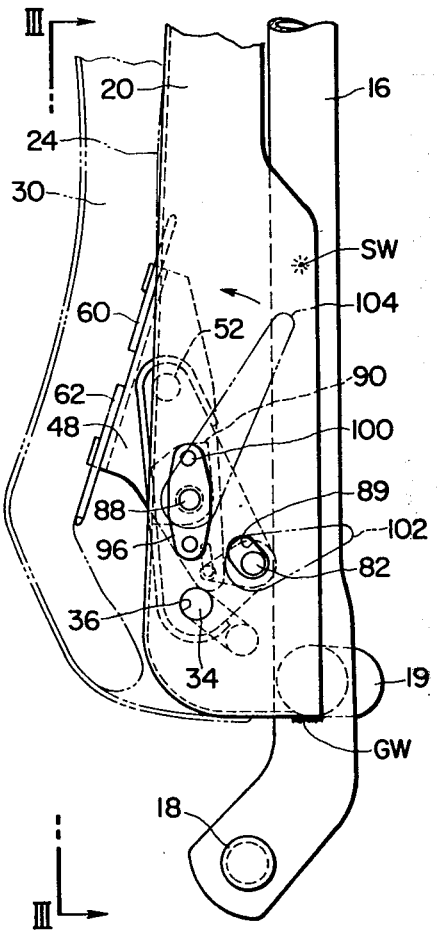
FIG. 2 is an enlarged partial view taken on the line II–II of FIG. 1.
Figure 3:
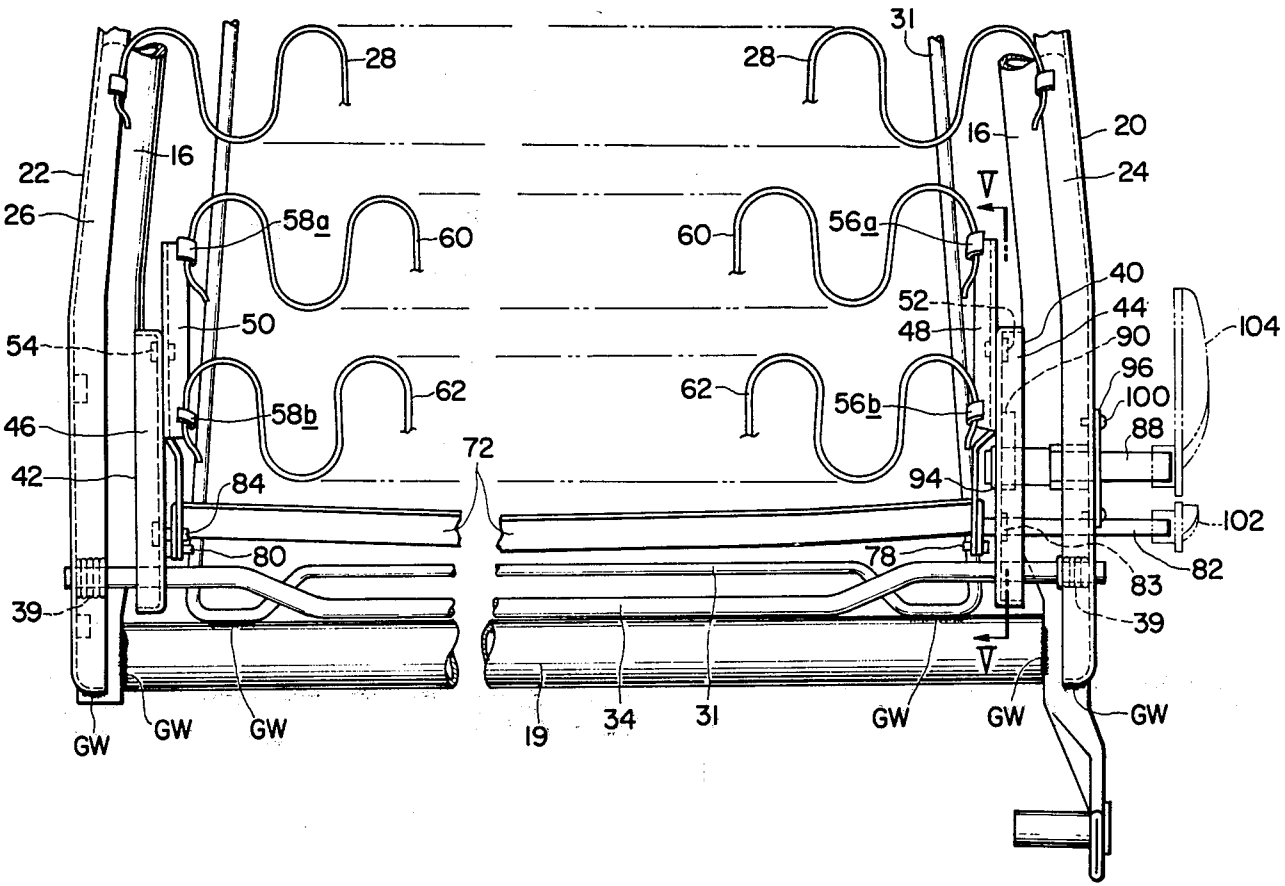
FIG. 3 is a view taken on the III–III of FIG. 2.
Figure 4:
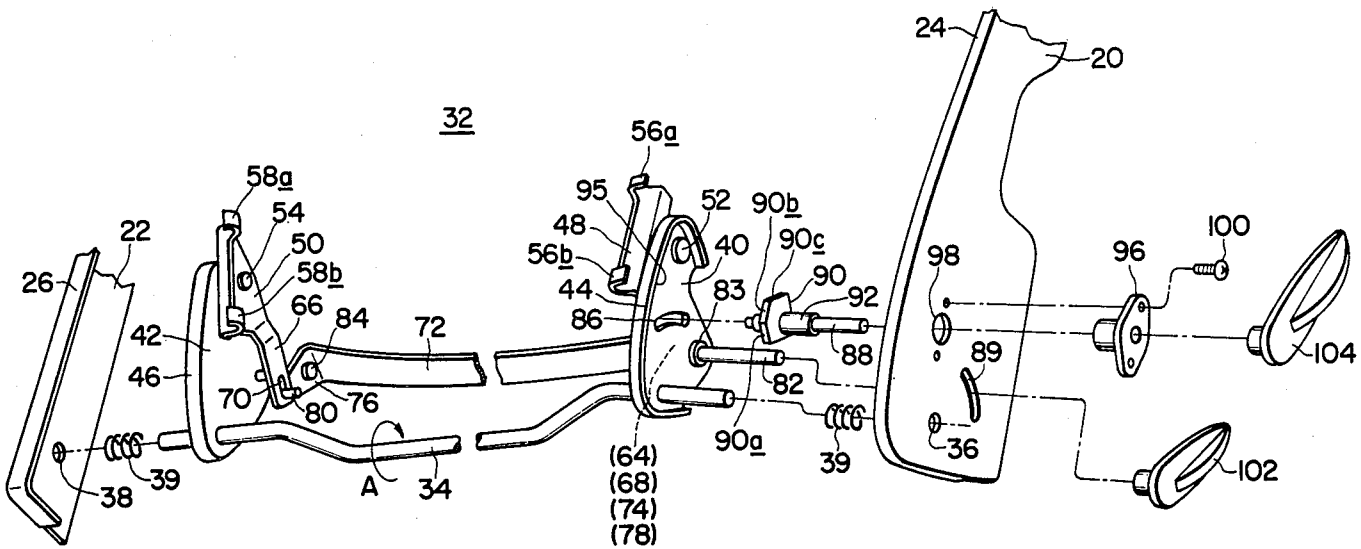
FIG. 4 is an exploded view of a part of the seat of the invention.

Description on the detailed construction of the adjustable lumbar supporter 32 will be made with the aid of FIGS. 2 to 4. In FIG. 4, an exploded view of the lumbar supporter 32 is illustrated with omission of several parts. As shown, the lumbar supporter 32 comprises an elongate rod 34 having ends rotatably disposed in holes 36 and 38 formed in lower portions of the respective side brackets 20 and 22. The elongate rod 34 shown includes an offset portion (no numeral). Helical springs 39 are arranged on end portions of the elongate rod 34 to bias the same to rotate in a direction as viewed by an arrow A.

A pair of triangular arms 40 and 42 are firmly connected via welding at their apex sections to the elongate rod 34 being parallel with and spaced from each other. Each of the arms 40 and 42, or at least the arm 40 has a flange 44 (or 46) which extends toward the adjacent side bracket 20 (or 22). A pair of spring supporters 48 and 50 are pivotally connected to inboard surfaces of the triangular arms 40 and 42 via respective pins 52 and 54. Each of the spring supporters 48 and 50 is formed with two spaced hook portions 56*a* and 56*b* or 58*a* and 58*b*. These hook portions are used for arranging alternately curved two springs 60 and 62 between the spring supporters 48 and 50 in parallel relation, as well shown in FIG. 3. For the reason which will become clear hereinlater, the hook portions of the spring supporters 48 and 50 are such constructed as to permit the parallelly arranged springs 60 and 62 to face substantially forwardly. Each of the spring supporters 48 and 50 is further formed with a downwardly extending arm section 64 (or 66) in which a longitudinally extending elongate slot 68 (or 70) is provided. A control arm 72 having rectangularly bent ends 74 76 is arranged between the arm sections 64 and 66 in a manner that pins 78 and 80 which extend from the respctive bent ends 74 and 76 are slidably disposed in the elongate slots 68 and 70 of the arm sections 64 and 66 of the spring supporters 48 and 50. As is best seen from FIG. 3, a control shaft 82 passing through the triangular arm 40 via a bushing 83 is firmly connected at one end thereof to the outboard wall surface of the bent end 74 of the control arm 72. A pin 84 loosely passing through the bent end 76 is firmly fixed to the triangular arm 42. Thus, it will be appreciated that the rotation of the control shaft 82 about the axis thereof in clockwise direction in FIG. 4 induces the clockwise rotation of the control arm 72 about an imaginary axis passing through the axes of the control shaft 82 and the pin 84 thereby simultaneously permitting the spring supporters 48 and 50 to swing counterclockwise about an imaginary axis passing through the pins 52 and 54. The other end of the control shaft 82 is slidably disposed in an arcuate opening 89 formed in the side bracket 20. The opening 89 is arranged to form a part of an imaginary circle which has the center thereof at the center of the hole 36 for the elongate rod 34.

The triangular arm 40 is formed with an arcuate opening 86 at its generally middle section, the opening being so constructed as to form a part of an imaginary circle which has the center thereof at the center of the opening of the arm 40 through which opening the elongate rod 34 is passed. Slidably disposed in the arcuate opening 86 is an end of a control shaft 88 on which a cam member 90 with first, second and third cam surfaces 90*a*, 90*b* and 90*c* is securely mounted through a collar 92. As will be seen from FIG. 5A, the first and second cam surfaces 90*a* and 90*b* intersect at 45-degree angles, and the second and third cam surfaces intersect at 45-degree angles, also. A snap ring 94 (shown in FIG. 3) is fixed to one end of the control shaft 88 for retaining the same to the triangular arm 40. The connection of the control shaft 88 with the triangular arm 40 is so made that the cam surfaces 90*a*, 90*b* and 90*c* of the cam member 90 are brought into contact with an inner surface portion 95 of the flange 44 of the triangular arm 40 upon rotation of the shaft 88 about the axis thereof. As is well shown in FIG. 5A, the distance from the axis of the control shaft 88 to the cam surface 90*a* is shorter than that to the cam surface 90*b*, while the distance to the latter is shorter than that to the cam surface 90*c*. The other end of the control shaft 88 is rotatably disposed in a bracket 96 which is tightly disposed in a hole 98 formed in the side bracket 20 at a position above the hole 36. Bolts 100, though only one is illustrated, are used for connecting the bracket 96 to the side bracket 20, as shown in FIG. 4.

A height control lever 102 and a fore-and-aft control lever 104 are respectively fixed to the shaft 82 and the shaft 88 so as to rotate their corresponding shafts when handled. Preferably, these levers 102 and 104 are such arranged that the respective longitudinal axes thereof are perpendicular to the axes of the corresponding shafts 82 and 88.

Figure 5A:
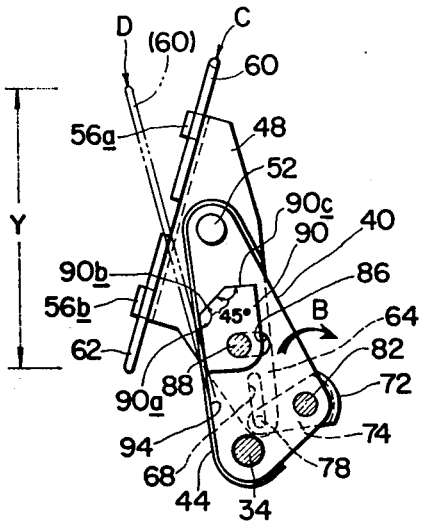
FIGS. 5A and 5B are views each taken on the line V–V of FIG. 3, showing respectively lower and upper section supporting conditions of a lumbar supporter equipped in the seat of the invention.

With the above-described construction, the operation of the adjustable lumbar supporter 32 is as follows Explanation on handling the height control lever 102 will be made with the aid of FIGS. 5A and 5B.

Figure 5B:
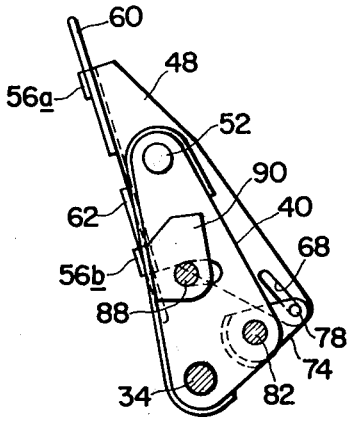

When the height control lever 102 (not shown in these figures) is rotated about 180-degree angles rotating the control shaft 82 clockwise, that is in a direction as shown by arrow B, the control arm 72 is simultaneously rotated with its bent end 74 in the same direction while rotating, via the pin 78, the downwardly extending arm section 64 of the supporter 48 about the pin 52 in a counterclockwise direction and finally setting the supporter 48 in a position shown in FIG. 5B. With this, the parallelly arranged springs 60 and 62 on the spring supporters 48 and 50 move from a position denoted by "C" to another position denoted by "D", as viewed in FIG. 5A. It should be now noted that in the position of "C", the lower end of the spring 62 is most projected forwardly thus strongly pressing a predetermined lower portion of the padding means 30 forwardly as viewed in FIG. 2, while in the position of "D", the upper end of the spring 60 is most projected forwardly thus strongly pressing a predetermined upper portion of the same forwardly. In other words, a forwardly projected part of the padding means 30 which contributes substantially to lumbar supporting moves upwardly or downwardly by a distance of "Y" upon handling of the height control lever 102. It should be noted that under the handling of the height control lever 102, the triangular arms 40 and 42 and the elongate rod 34 remain stationary.

Figure 6A:
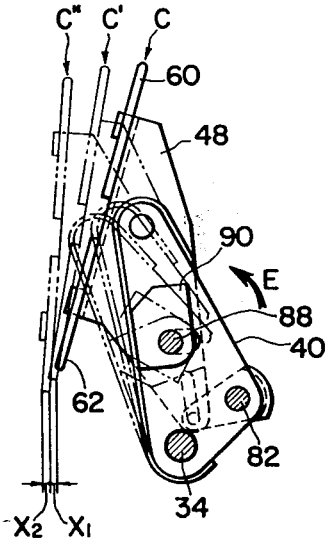
FIGS. 6A and 6B are views similar to FIGS. 5A and 5B, each showing front and rear section supporting conditions of the lumbar supporter in case of the respective lower and upper section supporting conditions thereof.

Explanation on handling of the fore-and-aft control lever 104 will be made by the aid of FIGS. 6A and 6B. FIG. 6A shows the fore-and-aft movements of the lumbar supporter under a condition in which the lower end of the spring 62 is most projected forwardly, and FIG. 6B shows the fore-and-aft movements of the lumbar supporter under a condition in which the upper end of the spring 60 is most projected forwardly.

Figure 6B:
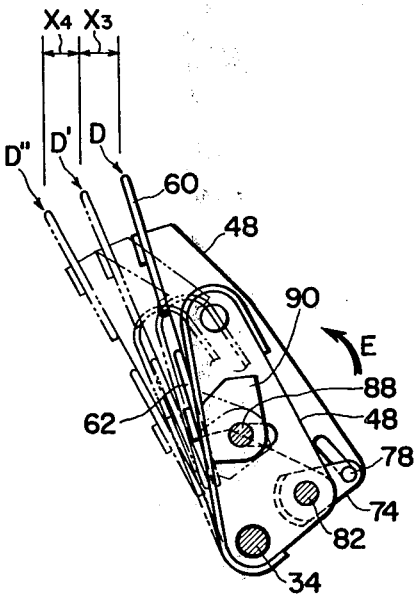

When, in either cases of FIGS. 6A and 6B, the fore-and-aft control lever 104 (not shown in these drawings) is rotated about 45-degree angles rotating the control shaft 88 in a direction as indicated by an arrow "E", the cam member 90 securedly mounted on the shaft 88 is simultaneously rotated in the same direction from a position as indicated by "C" or "D", where, as shown by a solid line, the cam surface 90*a* engages the inner surface portion 95 of the flange 44 of the triangular arm 40 to a position where the cam surface 90*b* engages the inner surface 44. With this, the triangular arm 40 and thus the arm 42 are rotated forwardly with the elongate rod 34 allowing the parallely arranged springs 60 and 62 on the spring supporters 48 and 50 to take a position indicated by "C'" or "D'". When the fore-and-aft control lever 104 is rotated further about 45-degree angles, the cam surface 90c is brought into contact which the inner surface section 94 thus setting the springs 60 and 62 in a position indicated by "C'" or "D'".

Now, it should be noted that in the case of FIG. 6A, the most forwardly projected portion of the springs 60 and 62, that is the lower end of the spring 62, is moved forwardly by a distance of "$X_1$" by the first 45-degree angle rotation of the lever 104 and moved further forwardly by a distance of "$X_2$" by the further 45-degree angle rotation of the same, and in the case of FIG. 6B, the most forwardly projected portion of the springs 60 and 62 is moved forwardly by a distance of "$X_3$" by the first 45-degree angle rotation of the lever 104 and moved further forwardly by a distance of "$X_4$" by the further 45-degree angle rotation of the same. In either cases of FIGS. 6A and 6B, a forwardly projected portion of the padding means 30 moves forwardly or rearwardly upon handling of the fore-and-aft control lever 104.

Although not shown in the drawings, the hook portions 56a and 58a (see FIG. 4) may be constructed separated from their corresponding spring supporters 40 and 42 and pivotally connected to the same respectively. In this case, the spring 60 can normally face forwardly irrespective of the angular position of the spring supporters 48 and 50.

It should be noted that the foregoing description shows only one exemplary embodiment. Various modifications are apparent to those skilled in the art without departing from the scope of the present invention which is only limited by the appended claims.

WHAT IS CLAIMED IS:

1. A seat backrest having two parallel but spaced frame members by which a contourable portion constituted by padding means is supported, and a lumbar supporter for imparting a curavature to said contourable portion to produce a desired contour, said lumbar supporter comprising:

a rod transversely crossing said frame members so as to be rotatable about the axis thereof relative to said frame members;

an arm member secured at its one end portion to said rod so as to be located between said frame members;

a support member pivotally connected to said arm member;

lumbar pressing means connected to said support member;

first control means for permitting said support member to rotate about its pivoted connection relative to said arm member when operated; and second control means for permitting said arm member and thus said rod to rotate about the axis of said rod relative to said frame members when operated.

2. A seat backrest having first and second parallel but spaced frame members by which a contourable portion constituted by padding means is supported, and a lumbar supporter for imparting a curvature to said contourable portion to produce a desired contour, said lumbar supporter comprising:

a rod transverely crossing said frame members and rotatable about the axis thereof relative to said frame members;

first and second spaced arm members secured at their one end portions to said rod and located between said frame members, said first arm member being located between said second arm member and said first frame member;

first and second support members pivotally connected to said first and second arm members, respectively;

at least one spring member spanned between said support members;

first control means for permitting said support members to rotate about their corresponding pivoted connections relative to said arm members when operated; and second control means for permitting said arm members and thus said rod to rotate about the axis of said rod relative to said frame members when operated.

3. A seat backrest as claimed in claim 2, in which each of said support members is connected via a pivot pin to the inboard surface of the corresponding arm member.

4. A seat backrest as claimed in claim 3, in which said first control means comprises:

an elongate arm member disposed between said first and second arm members and rotatable about the longitudinal axis thereof relative to said arm members;

means for transmitting the rotational movement of said elongate arm member to said first and secon support members to provide rotation of said support members about the corresponding pivoted portions with respect to said arm members; and a shaft passing through openings which are respectively formed in said frame member and said first arm member such that said shaft is rotatable about the axis thereof relative to both said first frame member and said first arm member, said shaft being connected to said means in a manner that the rotation of said shaft about the axis thereof induces the rotation of said elongate arm member about the longitudinal axis of said elongate arm member.

5. A seat backrest as claimed in claim 4, in which the opening of said first frame member is in the arcuate form so as to constitute a part of an imaginary circle the center of which is positioned at a center of a circular opening formed in said first frame member through which circular opening said rod is loosely passed.

6. A seat backrest as claimed in claim 5, in which said means comprises:

first and second sections which radially outwardly extend in a substantially same direction from respective longitudinal ends of said elongate arm member, said first and second sections being pivotally connected to said first and second arm members for permitting the rotation of said elongate arm member about the longitudinal axis thereof;

a pin fixed to each of said first and second sections;

a section of each of said first and second support members, said section being formed with an elongate slot into which said pin is slidably disposed.

7. A seat backrest as claimed in claim 6, in which said first section is connected to said first arm member through said shaft, and said second section is connected to said second arm member via a pivot pin.

8. A seat backrest as claimed in claim 7, further comprising a first control lever which is connected to an end of said shaft in a manner that the longitudinal axis of said lever is perpendicular to the axis of said shaft.

9. A seat backrest as claimed in claim 5, in which said second control means comprises:

a cam member having thereon a plurality of cam surfaces; and means for permitting said cam surfaces of said cam member to selectively contact with a part of said first arm member to rotate said first arm member and thus said rod and said second arm member about the axis of said rod when actuated.

10. A seat backrest as claimed in claim 9, in which said means comprises:

a shaft mounting thereon said cam member and having one end portion loosely passing through an arcuate opening formed in said first arm member and the other end portion loosely passing through an opening formed in said first frame member, said arcuate opening being formed to constitute a part of an imaginary circle the center of which is positioned at a center of a circular opening formed in said first arm member through which circular opening said rod is passed; and a snap pin fixed to the one end portion of said shaft for preventing the same from being disengaged from said first arm member.

11. A seat backrest as claimed in claim 10, further comprising a second control lever which is connected to the other end portion of said shaft in a manner that the longitudinal axis of said lever is perpendicular to the axis of said shaft.

12. A seat backrest as claimed in claim 2, in which said rod and thus said first and second arm members are biased to rotate about the axis of said rod in a direction in which said arm members are moved away from said contourable portion.

* * * * *